US005945392A

United States Patent [19]

Boutique et al.

[11] Patent Number: 5,945,392

[45] Date of Patent: Aug. 31, 1999

[54] NONAQUEOUS, PARTICULATE-CONTAINING DETERGENT COMPOSITIONS

[75] Inventors: Jean-Pol Boutique, Ernage, Belgium; Michael Eugene Burns, Hamilton, Ohio; James Pyott Johnston, Overijse; Axel Meyer, Brussels, both of Belgium

[73] Assignee: Procter & Gamble Company, Cincinnati, Ohio

[21] Appl. No.: 08/973,919

[22] PCT Filed: Jun. 20, 1995

[86] PCT No.: PCT/US95/07823

§ 371 Date: Dec. 22, 1997

§ 102(e) Date: Dec. 22, 1997

[87] PCT Pub. No.: WO97/00937

PCT Pub. Date: Jan. 9, 1997

[51] Int. Cl.[6] ..... C11D 3/32; C11D 3/395; C11D 7/38; C11D 7/54

[52] U.S. Cl. ..... 510/372; 510/376; 510/375; 8/111; 252/186.38

[58] Field of Search ..... 510/372, 371, 510/375, 376; 8/111; 252/186.38

[56] References Cited

U.S. PATENT DOCUMENTS

| | | | |
|---|---|---|---|
| 4,208,295 | 6/1980 | Sai et al. | 252/94 |
| 4,601,845 | 7/1986 | Namnath | 252/99 |
| 4,623,357 | 11/1986 | Urban | 8/107 |
| 4,634,551 | 1/1987 | Burns et al. | 252/102 |
| 4,681,592 | 7/1987 | Hardy et al. | 8/111 |
| 4,839,084 | 6/1989 | Ouhadi et al. | 252/174.21 |
| 4,852,989 | 8/1989 | Burns et al. | 8/107 |
| 4,959,187 | 9/1990 | Fong et al. | 260/402 |
| 5,414,099 | 5/1995 | Heinzman et al. | 554/69 |

FOREIGN PATENT DOCUMENTS

| | | |
|---|---|---|
| A 0 540 090 | 5/1993 | European Pat. Off. . |
| 2 048 930 | 12/1980 | United Kingdom . |
| 2 200 366 | 8/1988 | United Kingdom . |

*Primary Examiner*—Yogendra N. Gupta
*Assistant Examiner*—John M. Petruncio
*Attorney, Agent, or Firm*—C. Brant Cook; K. W. Zerby; Jacobus C. Rasser

[57] ABSTRACT

Nonaqueous detergent compositions which are in the form of a liquid, paste or gel, wherein the compositions comprise a divalent and/or trivalent metal salt bleach activator are disclosed.

10 Claims, No Drawings

NONAQUEOUS, PARTICULATE-CONTAINING DETERGENT COMPOSITIONS

FIELD OF THE INVENTION

This invention relates to nonaqueous laundry detergent products which are in the form of a liquid, gel or paste and which are in the form of stable dispersions of particulate material such as bleaching agents and bleach activators.

BACKGROUND OF THE INVENTION

Detergent products in the form of liquid, gel or paste are often considered to be more convenient to use than are dry powdered or particulate detergent products. Said detergents have therefore found substantial favor with consumers. Such detergent products are readily measurable, speedily dissolved in the wash water, capable of being easily applied in concentrated solutions or dispersions to soiled areas on garments to be laundered and are non-dusting. They also usually occupy less storage space than granular products. Additionally, such detergents may have incorporated in their formulations materials which could not withstand drying operations without deterioration, which operations are often employed in the manufacture of particulate or granular detergent products.

Although said detergents have a number of advantages over granular detergent products, they also inherently possess several disadvantages. In particular, detergent composition components which may be compatible with each other in granular products may tend to interact or react with each other. Thus such components as enzymes, surfactants, perfumes, brighteners, solvents and especially bleaches and bleach activators can be especially difficult to incorporate into liquid detergent products which have an acceptable degree of chemical stability.

One approach for enhancing the chemical compatibility of detergent composition components in detergent products has been to formulate nonaqueous (or anhydrous) detergent compositions. In such nonaqueous products, at least some of the normally solid detergent composition components tend to remain insoluble in the liquid product and hence are less reactive with each other than if they had been dissolved in the liquid matrix. Nonaqueous liquid detergent compositions, including those which contain reactive materials such as peroxygen bleaching agents, have been disclosed for example, in Hepworth et al., U.S. Pat. No. 4,615,820, Issued Oct. 17, 1986; Schultz et al., U.S. Pat. No. 4,929,380, Issued May 29, 1990; Schultz et al., U.S. Pat. No. 5,008,031, Issued Apr. 16, 1991; Elder et al., EP-A-030,096, Published Jun. 10, 1981; Hall et al., WO 92/09678, Published Jun. 11, 1992 and Sanderson et al., EP-A-565,017, Published Oct. 13, 1993.

Difficulties that have been observed with the incorporation of bleach activators in non-aqueous detergents, include the chemical and/or physical stability of the bleach activators. EP 339 995 describes a non-aqueous liquid detergent composition comprising a persalt bleach and a precursor therefore, the composition containing a capped alkoxylated nonionic surfactant. EP 540 090 proposes to use a bleach precursor which is relatively insoluble in the non aqueous liquid phase of the liquid detergent composition.

A difficulty associated with the stability of bleach activators is that, upon dilution in the wash liquor, the bleach activators still need to have a certain degree of solubility high enough to be effective as a bleaching species in the wash liquor.

Given the foregoing, there is clearly a continuing need to identify and provide nonaqueous, bleach activator-containing detergent compositions in the form of liquid, gel or paste products that have a high degree of chemical stability in the concentrate along with an efficient bleaching performance in the wash liquor.

Accordingly, it is an object of the present invention to provide a non-aqueous detergent composition wherein the bleach activators are chemically stable in the concentrate, while at the same time still being effective as bleach species in the wash liquor.

According to the present invention, there is provided a nonaqueous detergent composition which is in the form of a liquid, gel or paste, containing a bleaching agent and a bleach activator which is present as a divalent metal salt, a trivalent metal salt, a mixed metal salt whereby at least one of the salts is a divalent or a trivalent metal salt, or mixtures thereof.

SUMMARY OF THE INVENTION

The present invention provides a nonaqueous heavy-duty detergent composition which is in the form of a liquid, gel or paste, said composition comprising a bleaching agent and a bleach activator, characterized in that said bleach activator is present as a divalent metal salt, a trivalent metal salt, a mixed metal salt whereby at least one of the salts is a divalent or a trivalent metal salt, or mixtures thereof.

DETAILED DESCRIPTION OF THE INVENTION

1. Bleaching Agents and Bleach Activators

The bleaching agents used herein can be any of the bleaching agents useful for detergent or bleaching compositions in textile cleaning, hard surface cleaning, or other cleaning purposes that are now known or become known, and are useful for bleaching compositions as used in the present invention to treat fabrics. These include oxygen bleaches as well as other bleaching agents. Perborate bleaches, e.g., sodium perborate (e.g., mono- or tetrahydrate) can be used herein.

Peroxygen bleaching agents are preferably used in the compositions. Suitable peroxygen bleaching compounds include perborate, sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

The bleach activators according to the present invention are present as a divalent and/or trivalent metal salt. The bleach activator salt can be added as a powder dispersed in the non-aqueous base. The bleach activator salt can also be premixed with a liquid non-aqueous ingredient such as a nonionic surfactant, organic solvent and/or mixtures thereof. The bleach activator salts can be obtained by any method known to prepare divalent metal salts of anionic surface active solutions.

The bleach activator salts of the present invention can comprise mixed salts whereby at least one of the salts is a divalent or trivalent salt. The mixed salts are obtained by cocrystallization of the bleach activator salts. The mixed salts can comprise a monovalent salt. Examples of these salts are $Na_3Mg$ 4-[N-nonanoyl-6-aminohexanoyloxy benzene sulfonate]$_5$.

Preferred salts according to the present invention are Ca, Mg and Al salts. Highly preferred are Ca and Mg salts or mixtures thereof.

The bleach activators suitable for the present invention are the anionic bleach activators described in the literature, such as in the GB Patents 836,988; 864,798; 907,356; 1,003,310 and 1,519,351; German Patent 3,337,921; EP-A-0185522; EP-A-0174132; EP-A-0120591; and U.S. Pat. Nos. 1,246,339; 3,332,882; 4,128,494; 4,412,934 and 4,675,393.

A class of anionic bleach activators is that as disclosed in U.S. Pat. Nos. 4,751,015 and 4,397,757, in EP-A-284292, EP-A-331,229 and EP-A-03520. Examples of anionic peroxyacid bleach activators include sodium-4-benzoyloxy benzene sulphonate; sodium-1-methyl-2-benzoyloxy benzene-4-sulphonate; sodium nonanoyloxybenzene sulphonate; sodium 3,5,5,-trimethyl hexanoyloxybenzene sulphonate.

Bleach activators also useful in the present invention are amide substituted compounds of the general formulas:

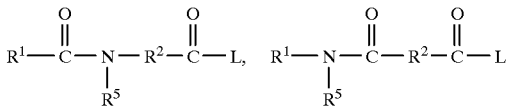

or mixtures thereof, wherein $R^1$ is an alkyl, aryl, or alkaryl group containing from about 1 to about 14 carbon atoms, $R^2$ is an alkylene, arylene or alkarylene group containing from about 1 to about 14 carbon atoms, $R^5$ is H or an alkyl, aryl, or alkaryl group containing from about 1 to about 10 carbon atoms, and L can be essentially any suitable leaving group. A leaving group is any group that is displaced from the bleaching activator as a consequence of the nucleophilic attack on the bleach activator by the perhydroxide anion. This, the perhydrolysis reaction, results in the formation of the peroxycarboxylic acid. Generally, for a group to be a suitable leaving group it must exert an electron attracting effect. It should also form a stable entity so that the rate of the back reaction is negligible. This facilitates the nucleophilic attack by the perhydroxide anion.

The L group must be sufficiently reactive for the reaction to occur within the optimum time frame (e.g., a wash cycle) . However, if L is too reactive, this activator will be difficult to stabilize for use in a bleaching composition. These characteristics are generally paralleled by the pKa of the conjugate acid of the leaving group, although exceptions to this convention are known. Ordinarily, leaving groups that exhibit such behavior are those in which their conjugate acid has a pKa in the range of from about 4 to about 13, preferably from about 6 to about 11 and most preferably from about 8 to about 11.

Preferred bleach activators are those of the above general formula wherein $R^1$, $R^2$ and $R^5$ are as defined for the peroxyacid and L is selected from the group consisting of:

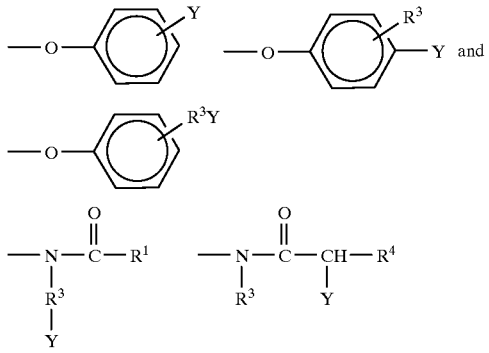

-continued

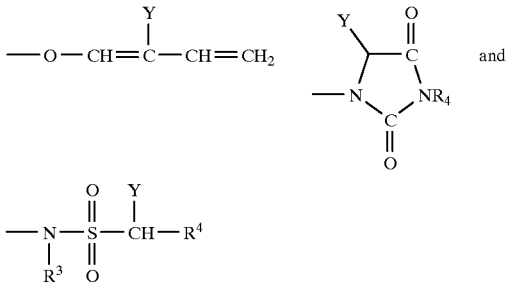

and mixtures thereof, wherein $R^1$ is an alkyl, aryl, or alkaryl group containing from about 1 to about 14 carbon atoms, $R^3$ is an alkyl chain containing from 1 to about 8 carbon atoms, $R^4$ is H or $R^3$, and Y is a solubilizing anionic group.

The solubilizing groups are $—SO_3^-$, $—CO_2^-$, $—SO_4^-$, and most preferably $—SO_3^-$ and $—CO_2^-$ wherein $R^3$ is an alkyl chain containing from about 1 to about 4 carbon atoms.

Preferred anionic bleach activators are those of the above general formula wherein L is selected from the group consisting of:

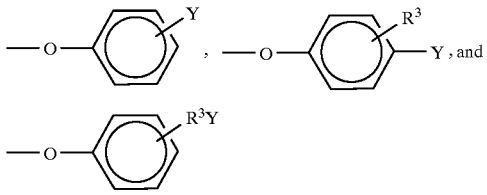

wherein $R^3$ is as defined above and Y is $—SO_3^-$ or $—CO_2^-$.

Preferred examples of bleach activators of the above formulae include 4-[N-octanoyl-6-aminohexanoyloxy] benzene sulfonate, 4-[N-nonanoyl-6-aminohexanoyloxy] benzene sulfonate, 4-[N-decanoyl-6-aminohexanoyloxy] benzene sulfonate and mixtures thereof. Said activators are described in U.S. Pat. No. 4,634,551 and U.S. Pat. No. 4,852,989.

Another important class of anionic bleach activators provide organic peracids as described herein by ring-opening as a consequence of the nucleophilic attack on the carbonyl carbon of the cyclic ring by the perhydroxide anion. For instance, this ring-opening reaction in certain activators involves attack at the lactam ring carbonyl by hydrogen peroxide or its anion. Since attack of an acyl lactam by hydrogen peroxide or its anion occurs preferably at the exocyclic carbonyl, obtaining a significant fraction of ring-opening may require a catalyst. Another example of ring-opening bleach activators can be found in other activators, such as those disclosed in U.S. Pat. No. 4,966,723, Hodge et al, issued Oct. 30, 1990.

Surprisingly, it has now been found that the bleach activators of the present invention in contrast with monovalent bleach activator salts, are chemically stable in the concentrate, while at the same time being effective as a bleach species in the wash liquor.

In addition, it has been found that bleach activators, when agglomerated with certain acid such as citric acid, are more chemically stable.

The nonaqueous detergent compositions of this invention may further comprise a surfactant- and low-polarity solvent-containing liquid gel phase having dispersed therein the bleach activator salt. The components of the liquid and solid phases of the detergent compositions herein, as well as composition form, preparation and use, are described in greater detail as follows:

All concentrations and ratios are on a weight basis unless otherwise specified.

Surfactant

The amount of the surfactant mixture component of the detergent compositions herein can vary depending upon the nature and amount of other composition components and depending upon the desired Theological properties of the ultimately formed composition. Generally, this surfactant mixture will be used in an amount comprising from about 10% to 90% by weight of the composition. More preferably, the surfactant mixture will comprise from about 15% to 50% by weight of the composition.

A typical listing of anionic, nonionic, ampholytic and zwitterionic classes, and species of these surfactants, is given in U.S. Pat. No. 3,664,961 issued to Norris on May 23, 1972.

Preferred anionic surfactants include the alkyl sulfate surfactants hereof are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{18}$ alkyl component, more preferably a $C_{12}$–$C_{15}$ alkyl or hydroxyalkyl, and M is H or a cation, e.g., an alkali metal cation (e.g. sodium, potassium, lithium), or ammonium or substituted ammonium (quaternary ammonium cations such as tetramethyl-ammonium and dimethyl piperdinium cations).

Highly preferred anionic surfactants include alkyl alkoxylated sulfate surfactants hereof are water soluble salts or acids of the formula $RO(A)_mSO3M$ wherein R is an unsubstituted $C_{10}$–$C_{24}$ alkyl or hydroxyalkyl group having a $C_{10}$–$C_{24}$ alkyl component, preferably a $C_{12}$–$C_{18}$ alkyl or hydroxyalkyl, more preferably $C_{12}$–$C_{15}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include quaternary ammonium cations such as tetramethyl-ammonium and dimethyl piperdinium cations Exemplary surfactants are $C_{12}$–$C_{15}$ alkyl polyethoxylate (1.0) sulfate ($C_{12}$–$C_{15}E(1.0)M$), $C_{12}$–$C_{15}$ alkyl polyethoxylate (2.25) sulfate ($C_{12}$–$C_{15}E(2.25)M$), $C_{12}$–$C_{15}$ alkyl polyethoxylate (3.0) sulfate ($C_{12}$–$C_{15}E(3.0)M$), and $C_{12}$–$C_{15}$ alkyl polyethoxylate (4.0) sulfate ($C_{12}$–$C_{15}E(4.0)M$), wherein M is conveniently selected from sodium and potassium.

Other suitable anionic surfactants to be used are alkyl ester sulfonate surfactants including linear esters of $C_8$–$C_{20}$ carboxylic acids (i.e., fatty acids) which are sulfonated with gaseous $SO_3$ according to "The Journal of the American Oil Chemists Society", 52 (1975), pp. 323–329. Suitable starting materials would include natural fatty substances as derived from tallow, palm oil, etc.

The preferred alkyl ester sulfonate surfactant, especially for laundry applications, comprise alkyl ester sulfonate surfactants of the structural formula:

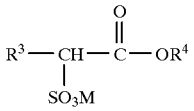

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations. Preferably, $R^3$ is $C_{10}$–$C_{16}$ alkyl, and $R^4$ is methyl, ethyl or isopropyl. Especially preferred are the methyl ester sulfonates wherein $R^3$ is $C_{10}$–$C_{16}$ alkyl.

Other anionic surfactants useful for detersive purposes can also be included in the laundry detergent compositions of the present invention. These can include salts (including, for example, sodium, potassium, ammonium, and substituted ammonium salts such as mono-, di- and triethanolamine salts) of soap, $C_9$–$C_{20}$ linear alkylbenzenesulfonates, $C_8$–$C_{22}$ primary of secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl glycerol sulfonates, fatty acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinates (especially saturated and unsaturated $C_{12}$–$C_{18}$ monoesters) and diesters of sulfosuccinates (especially saturated and unsaturated $C_6$–$C_{12}$ diesters), sulfates of alkylpolysaccharides such as the sulfates of alkylpolyglucoside (the nonionic nonsulfated compounds being described below), and alkyl polyethoxy carboxylates such as those of the formula $RO(CH_2CH_2O)_k$—$CH_2COO$—M+ wherein R is a $C_8$–$C_{22}$ alkyl, k is an integer from 1 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are described in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

When included therein, the detergent compositions of the present invention typically comprise from about 1% to about 40%, preferably from about 5% to about 25% by weight of such anionic surfactants.

One class of nonionic surfactants useful in the present invention are condensates of ethylene oxide with a hydrophobic moiety to provide a surfactant having an average hydrophilic-lipophilic balance (HLB) in the range from 8 to 17, preferably from 9.5 to 14, more preferably from 12 to 14. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Especially preferred nonionic surfactants of this type are the $C_9$–$C_{15}$ primary alcohol ethoxylates containing 3–12 moles of ethylene oxide per mole of alcohol, particularly the $C_{12}$–$C_{15}$ primary alcohols containing 5–8 moles of ethylene oxide per mole of alcohol.

Another class of nonionic surfactants comprises alkyl polyglucoside compounds of general formula $$RO\ (C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides. Compounds of this type and their use in detergent are disclosed in EP-B 0 070 077, 0 075 996 and 0 094 118.

Also suitable as nonionic surfactants are poly hydroxy fatty acid amide surfactants of the formula

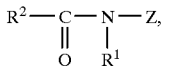

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or alkenyl chain such as coconut alkyl or mixtures thereof, and Z is derived from a reducing sugar such as glucose, fructose, maltose, lactose, in a reductive amination reaction.

Nonaqueous Liquid Diluent

To form the liquid gel of paste phase of the detergent compositions, the hereinbefore described surfactant (mixture) may be combined with a nonaqueous liquid diluent such as a liquid alcohol alkoxylate material or a nonaqueous, low-polarity organic solvent.

Alcohol Alkoxylates

One component of the liquid diluent suitable to form the compositions herein comprises an alkoxylated fatty alcohol material. Such materials are themselves also nonionic surfactants. Such materials correspond to the general formula:

$$R^1(C_mH_{2m}O)_nOH$$

wherein $R^1$ is a $C_8$–$C_{16}$ alkyl group, m is from 2 to 4, and n ranges from about 2 to 12. Preferably $R^1$ is an alkyl group, which may be primary or secondary, that contains from about 9 to 15 carbon atoms, more preferably from about 10 to 14 carbon atoms. Preferably also the alkoxylated fatty alcohols will be ethoxylated materials that contain from about 2 to 12 ethylene oxide moieties per molecule, more preferably from about 3 to 10 ethylene oxide moieties per molecule.

The alkoxylated fatty alcohol component of the liquid diluent will frequently have a hydrophilic-lipophilic balance (HLB) which ranges from about 3 to 17. More preferably, the HLB of this material will range from about 6 to 15, most preferably from about 8 to 15.

Examples of fatty alcohol alkoxylates useful as one of the essential components of the nonaqueous liquid diluent in the compositions herein will include those which are made from alcohols of 12 to 15 carbon atoms and which contain about 7 moles of ethylene oxide. Such materials have been commercially marketed under the trade names Neodol 25-7 and Neodol 23-6.5 by Shell Chemical Company. Other useful Neodols include Neodol 1-5, an ethoxylated fatty alcohol averaging 11 carbon atoms in its alkyl chain with about 5 moles of ethylene oxide; Neodol 23-9, an ethoxylated primary $C_{12}$–$C_{13}$ alcohol having about 9 moles of ethylene oxide and Neodol 91-10, an ethoxylated $C_9$–$C_{11}$ primary alcohol having about 10 moles of ethylene oxide. Alcohol ethoxylates of this type have also been marketed by Shell Chemical Company under the Dobanol tradename. Dobanol 91-5 is an ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 moles of ethylene oxide per mole of fatty alcohol.

Other examples of suitable ethoxylated alcohols include Tergitol 15-S-7 and Tergitol 15-S-9 both of which are linear secondary alcohol ethoxylates that have been commercially marketed by Union Carbide Corporation. The former is a mixed ethoxylation product of $C_{11}$ to $C_{15}$ linear secondary alkanol with 7 moles of ethylene oxide and the latter is a similar product but with 9 moles of ethylene oxide being reacted.

Other types of alcohol ethoxylates useful in the present compositions are higher molecular weight nonionics, such as Neodol 45-11, which are similar ethylene oxide condensation products of higher fatty alcohols, with the higher fatty alcohol being of 14–15 carbon atoms and the number of ethylene oxide groups per mole being about 11. Such products have also been commercially marketed by Shell Chemical Company.

The alcohol alkoxylate component when utilized as part of the liquid diluent in the nonaqueous compositions herein will generally be present to the extent of from about 1% to 60% by weight of the composition. More preferably, the alcohol alkoxylate component will comprise about 5% to 40% by weight of the compositions herein. Most preferably, the alcohol alkoxylate component will comprise from about 10% to 25% by weight of the detergent compositions herein.

Nonaqueous Low-Polarity Organic Solvent

Another component of the liquid diluent which may form part of the detergent compositions herein comprises nonaqueous, low-polarity organic solvent(s). The term "solvent" is used herein to connote the non-surface active carrier or diluent portion of the liquid phase of the composition. While some of the essential and/or optional components of the compositions herein may actually dissolve in the "solvent"-containing phase, other components will be present as particulate material dispersed within the "solvent"-containing phase. Thus the term "solvent" is not meant to require that the solvent material be capable of actually dissolving all of the detergent composition components added thereto.

The nonaqueous organic materials which are employed as solvents herein are those which are liquids of low polarity. For purposes of this invention, "low-polarity" liquids are those which have little, if any, tendency to dissolve one of the preferred types of particulate material used in the compositions herein, i.e., the peroxygen bleaching agents, sodium perborate or sodium percarbonate. Thus relatively polar solvents such as ethanol should not be utilized. Suitable types of low-polarity solvents useful in the nonaqueous liquid detergent compositions herein do include alkylene glycol mono lower alkyl ethers, lower molecular weight polyethylene glycols, lower molecular weight methyl esters and amides, and the like.

A preferred type of nonaqueous, low-polarity solvent for use herein comprises the mono-, di-, tri-, or tetra-$C_2$–$C_3$ alkylene glycol mono $C_2$–$C_6$ alkyl ethers. The specific examples of such compounds include diethylene glycol monobutyl ether, tetraethylene glycol monobutyl ether, dipropolyene glycol monoethyl ether, and dipropylene glycol monobutyl ether. Diethylene glycol monobutyl ether and dipropylene glycol monobutyl ether are especially preferred. Compounds of the type have been commercially marketed under the tradenames Dowanol, Carbitol, and Cellosolve.

Another preferred type of nonaqueous, low-polarity organic solvent useful herein comprises the lower molecular weight polyethylene glycols (PEGs). Such materials are those having molecular weights of at least about 150. PEGs of molecular weight ranging from about 200 to 600 are most preferred.

Yet another preferred type of non-polar, nonaqueous solvent comprises lower molecular weight methyl esters. Such materials are those of the general formula: $R^1$—C(O)—$OCH_3$ wherein $R^1$ ranges from 1 to about 18. Examples of suitable lower molecular weight methyl esters include methyl acetate, methyl propionate, methyl octanoate, and methyl dodecanoate.

The nonaqueous, low-polarity organic solvent(s) employed should, of course, be compatible and non-reactive with other composition components, e.g., bleach and/or activators, used in the liquid detergent compositions herein. Such a solvent component will generally be utilized in an amount of from about 1% to 60% by weight of the composition. More preferably, the nonaqueous, low-polarity organic solvent will comprise from about 5% to 40% by weight of the composition, most preferably from about 10% to 25% by weight of the composition.

Liquid Diluent Concentration

As with the concentration of the surfactant mixture, the amount of total liquid diluent in the compositions herein will be determined by the type and amounts of other composition components and by the desired composition properties. Generally, the liquid diluent will comprise from about 20% to 80% by weight of the compositions herein. More preferably, the liquid diluent will comprise from about 40% to 60% by weight of the composition.

SOLID PHASE

The nonaqueous detergent compositions herein may further comprise a solid phase of particulate material which is dispersed and suspended within the liquid phase. Generally such particulate material will range in size from about 0.1 to 1500 microns. More preferably such material will range in size from about 5 to 200 microns.

The particulate material utilized herein can comprise one or more types of detergent composition components which in particulate form are substantially insoluble in the nonaqueous liquid phase of the composition. The types of particulate materials which can be utilized are described in detail as follows:

Surfactants

Another possible type of particulate material which can be suspended in the nonaqueous liquid detergent compositions herein includes ancillary anionic surfactants which are fully or partially insoluble in the nonaqueous liquid phase. The most common type of anionic surfactant with such solubility properties comprises primary or secondary alkyl sulfate anionic surfactants. Such surfactants are those produced by the sulfation of higher $C_8$–$C_{20}$ fatty alcohols.

Conventional primary alkyl sulfate surfactants have the general formula $$ROSO_3^-M^+$$

wherein R is typically a linear $C_8$–$C_{20}$ hydrocarbyl group, which may be straight chain or branched chain, and M is a water-solubilizing cation. Preferably R is a $C_{10}$–$C_{14}$ alkyl, and M is alkali metal. Most preferably R is about $C_{12}$ and M is sodium.

Conventional secondary alkyl sulfates may also be utilized as the essential anionic surfactant component of the solid phase of the compositions herein. Conventional secondary alkyl sulfate surfactants are those materials which have the sulfate moiety distributed randomly along the hydrocarbyl "backbone" of the molecule. Such materials may be depicted by the structure $$CH_3(CH_2)_n(CHOSO_3^-M^+)\ (CH_2)_mCH_3$$

wherein m and n are integers of 2 or greater and the sum of m+n is typically about 9 to 15, and M is a water-solubilizing cation.

If utilized as all or part of the requisite particulate material, ancillary anionic surfactants such as alkyl sulfates will generally comprise from about 1% to 10% by weight of the composition, more preferably from about 1% to 5% by weight of the composition. Alkyl sulfate used as all or part of the particulate material is prepared and added to the compositions herein separately from the unalkoxylated alkyl sulfate material which may form part of the alkyl ether sulfate surfactant component essentially utilized as part of the liquid phase herein.

Organic Builder Material

Another possible type of particulate material which can be suspended in the nonaqueous liquid detergent compositions herein comprises an organic detergent builder material which serves to counteract the effects of calcium, or other ion, water hardness encountered during laundering/bleaching use of the compositions herein. Examples of such materials include the alkali metal, citrates, succinates, malonates, fatty acids, carboxymethyl succinates, carboxylates, polycarboxylates and polyacetyl carboxylates. Specific examples include sodium, potassium and lithium salts of oxydisuccinic acid, mellitic acid, benzene polycarboxylic acids and citric acid. Other examples of organic phosphonate type sequestering agents such as those which have been sold by Monsanto under the Dequest tradename and alkanehydroxy phosphonates. Citrate salts are highly preferred.

Other suitable organic builders include the higher molecular weight polymers and copolymers known to have builder properties. For example, such materials include appropriate polyacrylic acid, polymaleic acid, and polyacrylic/polymaleic acid copolymers and their salts, such as those sold by BASF under the Sokalan trademark.

Another suitable type of organic builder comprises the water-soluble salts of higher fatty acids, i.e., "soaps". These include alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

If utilized as all or part of the requisite particulate material, insoluble organic detergent builders can generally comprise from about 2% to 20% by weight of the compositions herein. More preferably, such builder material can comprise from about 4% to 10% by weight of the composition.

Inorganic Alkalinity Sources

Another possible type of particulate material which can be suspended in the nonaqueous liquid detergent compositions herein can comprise a material which serves to render aqueous washing solutions formed from such compositions generally alkaline in nature. Such materials may or may not also act as detergent builders, i.e., as materials which counteract the adverse effect of water hardness on detergency performance.

Examples of suitable alkalinity sources include water-soluble alkali metal carbonates, bicarbonates, borates, silicates and metasilicates. Although not preferred for ecological reasons, water-soluble phosphate salts may also be utilized as alkalinity sources. These include alkali metal pyrophosphates, orthophosphates, polyphosphates and phosphonates. Of all of these alkalinity sources, alkali metal carbonates such as sodium carbonate are the most preferred.

The alkalinity source, if in the form of a hydratable salt, may also serve as a desiccant in the nonaqueous liquid detergent compositions herein. The presence of an alkalinity source which is also a desiccant may provide benefits in terms of chemically stabilizing those composition components such as the peroxygen bleaching agent which may be susceptible to deactivation by water.

If utilized as all or part of the particulate material component, the alkalinity source will generally comprise from about 1% to 15% by weight of the compositions herein. More preferably, the alkalinity source can comprise from about 2% to 10% by weight of the composition. Such materials, while water-soluble, will generally be insoluble in the nonaqueous detergent compositions herein. Thus such materials will generally be dispersed in the nonaqueous liquid phase in the form of discrete particles.

OPTIONAL COMPOSITION COMPONENTS

In addition to the composition liquid and solid phase components as hereinbefore described, the detergent compositions herein can, and preferably will, contain various optional components. Such optional components may be in either liquid or solid form. The optional components may either dissolve in the liquid phase or may be dispersed within the liquid phase in the form of fine particles or droplets. Some of the materials which may optionally be utilized in the compositions herein are described in greater detail as follows:

Optional Inorganic Detergent Builders

The detergent compositions herein may also optionally contain one or more types of inorganic detergent builders beyond those listed hereinbefore that also function as alkalinity sources. Such optional inorganic builders can include, for example, aluminosilicates such as zeolites. Aluminosilicate zeolites, and their use as detergent builders are more fully discussed in Corkill et al., U.S. Pat. No. 4,605,509; Issued Aug. 12, 1986, the disclosure of which is incorporated herein by reference. Also crystalline layered silicates, such as those discussed in this '509 U.S. patent, are also suitable for use in the detergent compositions herein. If utilized, optional inorganic detergent builders can comprise from about 2% to 15% by weight of the compositions herein.

Optional Enzymes

The detergent compositions herein may also optionally contain one or more types of detergent enzymes. Such enzymes can include proteases, amylases, cellulases and lipases. Such materials are known in the art and are commercially available. They may be incorporated into the nonaqueous liquid detergent compositions herein in the form of suspensions, "marumes" or "prills". Another suitable type of enzyme comprises those in the form of slurries of enzymes in nonionic surfactants. Enzymes in this form have been commercially marketed, for example, by Novo Nordisk under the tradename "LDP."

Enzymes added to the compositions herein in the form of conventional enzyme prills are especially preferred for use herein. Such prills will generally range in size from about 100 to 1,000 microns, more preferably from about 200 to 800 microns and will be suspended throughout the nonaqueous liquid phase of the composition. Prills in the compositions of the present invention have been found, in comparison with other enzyme forms, to exhibit especially desirable enzyme stability in terms of retention of enzymatic activity over time. Thus, compositions which utilize enzyme prills need not contain conventional enzyme stabilizing such as must frequently be used when enzymes are incorporated into aqueous liquid detergents.

If employed, enzymes will normally be incorporated into the nonaqueous liquid compositions herein at levels sufficient to provide up to about 10 mg by weight, more typically from about 0.01 mg to about 5 mg, of active enzyme per gram of the composition. Stated otherwise, the nonaqueous liquid detergent compositions herein will typically comprise from about 0.001% to 5%, preferably from about 0.01% to 1% by weight, of a commercial enzyme preparation. Protease enzymes, for example, are usually present in such commercial preparations at levels sufficient to provide from 0.005 to 0.1 Anson units (AU) of activity per gram of composition.

Optional Chelating Agents

The detergent compositions herein may also optionally contain a chelating agent which serves to chelate metal ions, e.g., iron and/or manganese, within the nonaqueous detergent compositions herein. Such chelating agents thus serve to form complexes with metal impurities in the composition which would otherwise tend to deactivate composition components such as the peroxygen bleaching agent. Useful chelating agents can include amino carboxylates, phosphonates, amino phosphonates, polyfunctionally-substituted aromatic chelating agents and mixtures thereof.

Amino carboxylates useful as optional chelating agents include ethylenediaminetetraacetates, N-hydroxyethylethylene-diaminetriacetates, nitrilotriacetates, ethylenediamine tetrapropionates, triethylenetetraaminehexacetates, diethylenetriaminepentaacetates, ethylenediaminedisuccinates and ethanoldiglycines. The alkali metal salts of these materials are preferred.

Amino phosphonates are also suitable for use as chelating agents in the compositions of this invention when at least low levels of total phosphorus are permitted in detergent compositions, and include ethylenediaminetetrakis (methylene-phosphonates) as DEQUEST. Preferably, these amino phosphonates do not contain alkyl or alkenyl groups with more than about 6 carbon atoms.

Preferred chelating agents include hydroxyethyldiphosphonic acid (HEDP), diethylene triamine penta acetic acid (DTPA), ethylenediamine disuccinic acid (EDDS) and dipicolinic acid (DPA) and salts thereof. The chelating agent may, of course, also act as a detergent builder during use of the compositions herein for fabric laundering/bleaching. The chelating agent, if employed, can comprise from about 0.1% to 4% by weight of the compositions herein. More preferably, the chelating agent will comprise from about 0.2% to 2% by weight of the detergent compositions herein.

Optional Thickening, Viscosity Control and/or Dispersing Agents

The detergent compositions herein may also optionally contain a polymeric material which serves to enhance the ability of the composition to maintain its solid particulate components in suspension. Such materials may thus act as thickeners, viscosity control agents and/or dispersing agents. Such materials are frequently polymeric polycarboxylates but can include other polymeric materials such as polyvinylpyrrolidone (PVP) and polymeric amine derivatives such as quaternized, ethoxylated hexamethylene diamines.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than about 40% by weight of the polymer.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000, and most preferably from about 4,000 to 5,000. Water-soluble salts of such acrylic acid polymers can include, for example, the alkali metal, salts. Soluble polymers of this type are known materials. Use of polyacrylates of this type in detergent compositions has been disclosed, for example, Diehl, U.S. Pat. No. 3,308,067, issued Mar. 7, 1967. Such materials may also perform a builder function.

If utilized, the optional thickening, viscosity control and/or dispersing agents should be present in the compositions herein to the extent of from about 0.1% to 4% by weight. More preferably, such materials can comprise from about 0.5% to 2% by weight of the detergents compositions herein.

Optional Brighteners, Suds Suppressors and/or Perfumes

The detergent compositions herein may also optionally contain conventional brighteners, suds suppressors, silicone oils, bleach catalysts, and/or perfume materials. Such brighteners, suds suppressors, silicone oils, bleach catalysts, and perfumes must, of course, be compatible and non-reactive with the other composition components in a non-aqueous environment. If present, brighteners suds suppressors and/or perfumes will typically comprise from about 0.1% to 2% by weight of the compositions herein.

Suitable bleach catalysts include the manganese based complexes disclosed in U.S. Pat. No. 5,246,621, U.S. Pat. No. 5,244,594, U.S. Pat. No. 5,114,606 and U.S. Pat. No. 5,114,611.

COMPOSITION FORM

The particulate-containing liquid detergent compositions of this invention are substantially nonaqueous (or anhydrous) in character. While very small amounts of water may be incorporated into such compositions as an impurity in the essential or optional components, the amount of water should in no event exceed about 5% by weight of the compositions herein. More preferably, water content of the nonaqueous detergent compositions herein will comprise less than about 1% by weight.

The particulate-containing nonaqueous detergent compositions herein will be in the form of a liquid, gel or paste.

COMPOSITION PREPARATION AND USE

The nonaqueous detergent compositions herein can be prepared by combining the bleach activator salts and optional components thereof in any convenient order and by mixing, e.g., agitating, the resulting component combination to form the phase stable compositions herein.

The compositions of this invention, prepared as hereinbefore described, can be used to form aqueous washing solutions for use in the laundering and bleaching of fabrics. Generally, an effective amount of such compositions is added to water, preferably in a conventional fabric laundering automatic washing machine, to form such aqueous laundering/bleaching solutions. The aqueous washing/bleaching solution so formed is then contacted, preferably under agitation, with the fabrics to be laundered and bleached therewith.

An effective amount of the liquid detergent compositions herein added to water to form aqueous laundering/bleaching solutions can comprise amounts sufficient to form from about 500 to 7,000 ppm of composition in aqueous solution. More preferably, from about 1,000 to 3,000 ppm of the detergent compositions herein will be provided in aqueous washing/bleaching solution.

EXAMPLE

The following example illustrates the compositions of the present invention, but is not necessarily meant to limit or otherwise define the scope of the invention herein.

A bleach-containing nonaqueous laundry detergent is prepared having the composition as set forth in Table I.

TABLE I

| Component | Wt. % |
|---|---|
| Liquid Base | |
| $C_{12-15}$ alkyl ether (EO = 3) sulfate Na salt | 17 |
| $C_{12-14}$ N-methyl glucamide | 9 |
| $C_{12-14}$, EO = 5 alcohol ethoxylate | 17 |
| N-Butoxy propoxy propanol (BPP) | 24 |
| Perfume | 0.7 |
| Solids | |
| Topped palm kernel fatty acid Na salt | 5.7 |
| Trisodium Citrate | 1.9 |
| Sodium percarbonate | 9.4 |
| Sodium carbonate | 7.5 |
| Sodium hydroxyethyl diphosphonate (HEDP)Na salt | 1.7 |
| [4-[N-nonanoyl-6-aminohexanoyloxy]benzene sulfonate]$_2$ Ca salt | 4.7 |
| Brightener | 0.2 |
| Silicone Oil DB-100 | 0.5 |
| Enzymes and minor | Up to 100% |

This composition is a stable anhydrous liquid laundry detergent wherein the bleach activator is stable in the concentrate and wherein the bleach activator is effective in the wash liquor.

What is claimed is:

1. A nonaqueous detergent composition which is in the form of a liquid, paste or gel, said nonaqueous detergent composition comprising a bleaching agent and an amide-substituted bleach activator, wherein said bleach activator is present as a divalent metal salt, a trivalent Al salt, a mixed metal salt whereby at least one of the salts is a divalent metal salt or trivalent Al salt, or mixtures thereof.

2. A nonaqueous detergent composition according to claim 1 wherein said divalent salt is selected from Ca and/or Mg.

3. A nonaqueous detergent composition according to claim 1 wherein said mixed metal salt comprises a monovalent metal.

4. A nonaqueous detergent composition according to claim 1 wherein said amide substituted bleach activator is selected from the group consisting of amide-substituted bleach activators having the following formula:

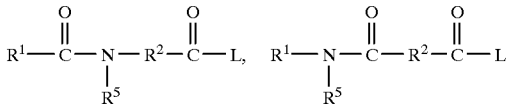

and mixtures thereof; wherein $R^1$ is an alkyl, aryl or alkaryl group containing from about 1 to about 14 carbon atoms, $R^2$ is an alkylene, arylene or alkarylene group containing from about 1 to 14 carbon atoms, $R^5$ is H or an alkyl, aryl or alkaryl group containing from about 1 to about 10 carbon atoms, and L is any suitable leaving group which is capable of being displaced from said bleach activator as a consequence of a nucleophilic attack on said bleach activator by a perhydroxide anion.

5. A nonaqueous detergent composition according to claim 1 wherein said amide-substituted bleach activator is selected from the group consisting of: 4-[N-octanoyl-6-aminohexanoyloxy]benzene sulfonate, 4-[N-nonanoyl-6-aminohexanoyloxy]benzene sulfonate, 4-[N-decanoyl-6-aminohexanoyloxy]benzene sulfonate and mixtures thereof.

6. A nonaqueous detergent composition according to claim 1 wherein said bleaching agent is percarbonate.

7. A nonaqueous detergent composition which is in the form of a liquid, paste or gel, said nonaqueous detergent composition comprising a bleaching agent and a bleach activator, wherein said bleach activator is present as a trivalent Al salt, a mixed metal salt whereby at least one of the salts is a trivalent Al salt, or mixtures thereof.

8. A nonaqueous detergent composition according to claim 7 wherein said mixed metal salt comprises a monovalent salt.

9. A nonaqueous detergent composition according to claim 7 wherein said mixed metal salt comprises a divalent salt.

10. A nonaqueous detergent composition according to claim 7 wherein said bleaching agent is percarbonate.

* * * * *